US005257079A

United States Patent [19]

Lange et al.

[11] Patent Number: 5,257,079

[45] Date of Patent: Oct. 26, 1993

[54] ELECTROSTATIC BRUSH CLEANER WITH A SECONDARY CLEANER

[75] Inventors: Clark V. Lange, Ontario; Bruce E. Thayer, Webster; N. Kedarnath, Fairport; Samuel P. Mordenga; Darryl L. Pozzanghera, both of Rochester, all of N.Y.

[73] Assignee: Xerox Corporation, Stamford, Conn.

[21] Appl. No.: 946,225

[22] Filed: Sep. 17, 1992

[51] Int. Cl.[5] ..... G03G 21/00

[52] U.S. Cl. ..... 355/303; 118/652; 15/1.51

[58] Field of Search ..... 355/301, 302, 303, 304, 355/297, 299, 300; 118/652; 15/256.52, 1.51

[56] References Cited

U.S. PATENT DOCUMENTS

| | | | |
|---|---|---|---|
| 3,795,025 | 3/1974 | Sadamitsu et al. | 15/256.52 |
| 3,801,197 | 4/1974 | Akiyama et al. | 355/4 |
| 4,469,435 | 9/1984 | Nosaki et al. | 118/652 X |
| 4,506,975 | 3/1985 | Shukuri et al. | 118/652 X |
| 4,640,599 | 2/1987 | Doutney | 355/3 CH |
| 4,878,093 | 10/1989 | Edmunds | 355/296 |
| 4,967,238 | 10/1990 | Bares et al. | 355/296 |
| 4,984,028 | 1/1991 | Tonomoto | 355/297 |
| 4,989,047 | 1/1991 | Jugle et al. | 355/297 |
| 4,999,679 | 3/1991 | Corbin et al. | 355/303 |
| 5,031,000 | 7/1991 | Pozniakas et al. | 355/297 |
| 5,081,505 | 1/1992 | Ziegelmuller et al. | 355/299 |
| 5,208,639 | 5/1993 | Thayer et al. | 355/299 |

*Primary Examiner*—R. L. Moses
*Attorney, Agent, or Firm*—T. L. Fair

[57] ABSTRACT

A cleaning brush electrically biased with an alternating current removes discharged particles from an imaging surface. The particles on the imaging surface are discharged by a corona generating device. A second cleaning device including an insulative brush, a conductive brush or a blade, located upstream of the first mentioned brush, in the direction of movement of the imaging surface, further removes redeposited particles therefrom.

5 Claims, 4 Drawing Sheets

FIG. 1
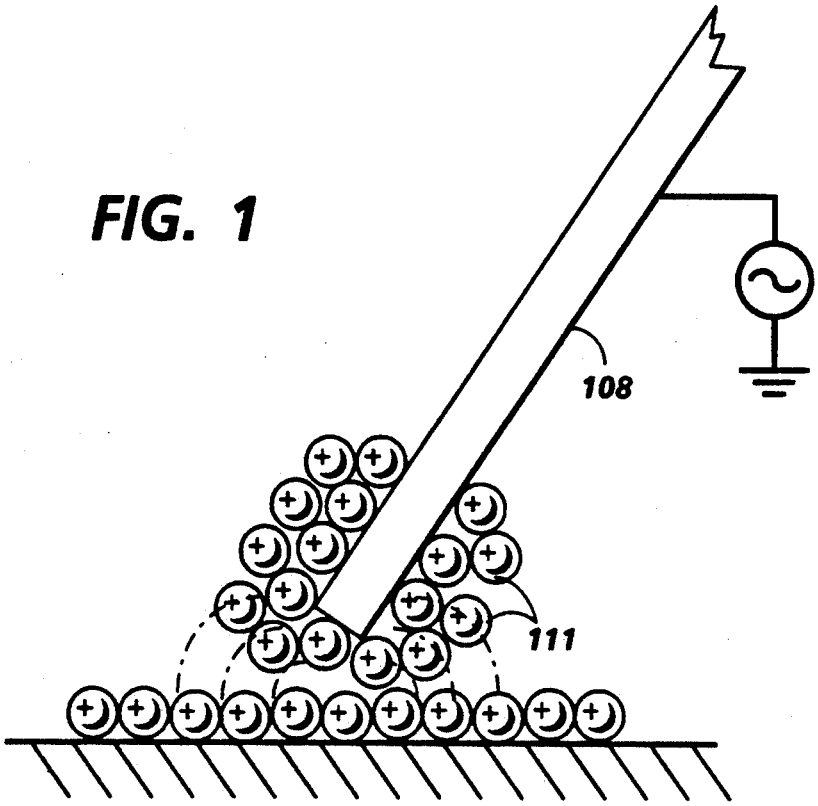
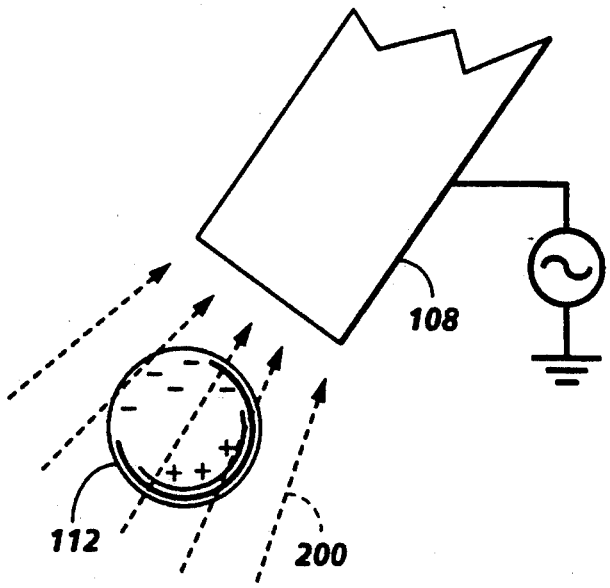
FIG. 2

ELECTROSTATIC BRUSH CLEANER WITH A SECONDARY CLEANER

BACKGROUND OF THE INVENTION

This invention relates generally to an electrostatographic printer or copier, and more particularly concerns a cleaning apparatus used therein.

There are electrophotographic printing machines which use a conductive brush with a negative DC (direct current) bias. Toner charged positively by the preclean dicorotron is thus cleaned by rotating the biased cleaner brush. Detoning of the brush is accomplished with detoning rolls and a flicker bar/vacuum system. This cleaner has difficulty cleaning wrong sign toner and wrong sign paper debris. Blade cleaners are used in many copiers but are not usually used in high volume machines due to their poor reliability. A high toner Mass/Area (M/A) entering the blade cleaner creates a stress input. It has been demonstrated that if the M/A could be reduced, cleaning could be performed at lower minimum blade loads. Additionally, on other machines it has been determined that comet formation (i.e. small deposits, usually consisting of toner and toner additives, which cannot be cleaned from a surface and can grow to a size which creates copy quality defects) on the photoreceptor was reduced by decreasing the blade load, which would be possible if the M/A was reduced. In multicolor copiers and printers of the future, it is important to provide the most robust cleaner designs to assure acceptable cleaning performance over the wide variety of materials and conditions that will be encountered. In an effort to achieve this robust cleaner, some work has been done with a single conductive brush with an AC electrical bias to allow cleaning of both polarity toners with the same brush. This single AC biased brush has been shown to work well on occasion, but frequently redeposition of toner from the brush to the photoreceptor surface (i.e. imaging surface) occurs after the cleaner brush has been used to clean toner from the photoreceptor surface.

Other machines have developed dual brush ESB (electrostatic brush) cleaners, where the first brush is negatively biased and the second brush is positively biased. This type of cleaner is a robust cleaner for two polarities of toner and debris where one brush picks up one polarity and the other brush picks up the opposite polarity. In multicolor copiers and printers of the future, it is important to provide the most robust cleaner designs to assure acceptable cleaning performance over the wide variety of materials and conditions encountered.

The following disclosures may be relevant to various aspects of the present invention and may be briefly summarized as follows:

U.S. Pat. No. 4,999,679 to Corbin et al. discloses an apparatus for cleaning a photoconductive surface. The apparatus includes a pair of oppositely electrically biased cleaning brushes. Each brush is located in a separate housing with each housing electrically biased to the same polarity as the brush located therein.

U.S. Pat. Nos. 4,989,047 and 5,031,000 to Jugle et al. and Pozniakas et al., respectively, disclose cleaning apparatus including a negatively DC biased fiber cleaning brush serving as a primary cleaning member, a blade member serving as a secondary cleaning member, and a vacuum detoning arrangement for the brush.

U.S. Pat. No. 4,984,028 to Tonomoto discloses a cleaning unit including a rotatable fur brush, a cleaning blade and a suction means working in cooperation therewith.

U.S. Pat. No. 4,878,093 to Edmunds discloses a dual roll cleaning apparatus. A cleaning housing which is connected to a vacuum supports an upstream brush roll cleaner and a downstream foam or poromeric roll cleaner. The brush roll cleaner provides a primary cleaning function, while the foam roll cleaner provides a secondary back up cleaning function.

U.S. Pat. No. 4,967,238 to Bares et al. discloses a cleaning performance monitor. The monitor detects toner or debris deposits on an imaging surface downstream from a cleaning station.

U.S. Pat. No. 4,640,599 to Doutney discloses a method and apparatus for cleaning a photoconductive surface. The apparatus includes an AC charged cleaning brush and a cleaning blade located immediately downstream from the cleaning brush. The cleaning brush is located downstream from a sheet separator and serves the purpose of removing residual toner from the photoconductive surface as well as any residual charge. The cleaning blade subsequently removes any remaining toner particles from the surface.

U.S. Pat. No. 3,801,197 to Akiyama et al. discloses a color electrophotographic copying apparatus including a cleaning device having successive cleaning means.

U.S. Pat. No. 3,795,025 to Sadamitsu, discloses an apparatus for cleaning an electrophotographic photoreceptor. The apparatus includes a pair of brushes rotating in opposite directions. The rotating brushes are enclosed in a brush box and a vacuum system removes toner from the brushes and the inside of the brush box.

SUMMARY OF INVENTION

Briefly stated, and in accordance with one aspect of the present invention, there is provided an apparatus for removing residual particles from an imaging surface. This cleaning apparatus comprises a housing that defines an open ended chamber. Means for discharging the residual particles on the imaging surface. A brush, rotatably mounted in the chamber of the housing for removing the discharged particles from the imaging surface. Means for electrically biasing said brush with an alternating current.

BRIEF DESCRIPTION OF THE DRAWINGS

Other features of the present invention will become apparent as the following description proceeds and upon reference to the drawings, in which:

FIG. 1 is an enlarged view of an AC biased conductive brush fiber, with charged toner;

FIG. 2 an enlarged view of an AC biased conductive brush fiber with an uncharged toner particle;

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 6:
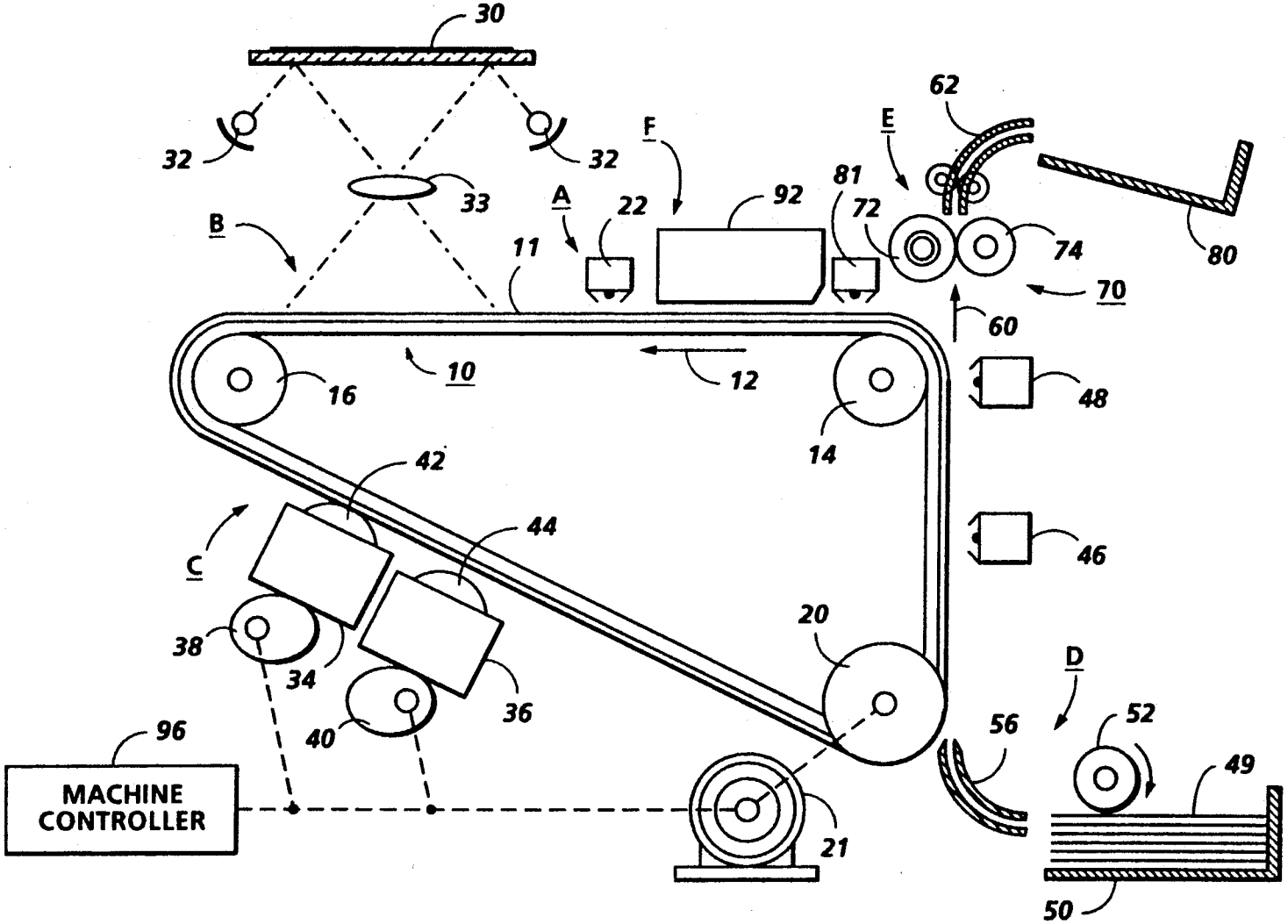
FIG. 6 is a schematic illustration of a printing apparatus incorporating the inventive features of the invention.

For a general understanding of an electrophotographic printer or copier in which the present invention may be incorporated, reference is made of FIG. 6 which depicts schematically the various components thereof. Hereinafter, like reference numerals will be employed throughout to designate identical elements. Although the electrostatic brush cleaner with a secondary cleaner apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 6 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 6, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The hybrid cleaner of the present invention is represented by the reference numeral 92. A corona generating device 81 discharges the residual particles on the imaging surface prior to entering the hybrid cleaner 92. (See FIGS. 3 to 5 for more detailed views of the cleaning apparatus.) Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1-5 where the showings are for the purpose of illustrating a preferred embodiment of the invention and not for limiting same.

Removal of charged dielectric particles adhered to a dielectric surface can be accomplished by mechanical, electrical or electro-mechanical means. The electrostatic brush cleaner employs a combination of electrical and mechanical forces to detach and remove toner particles from the photoreceptor surface.

In order to exert an electrostatic force on the toner particles, the toner particles are charged using a preclean corona device and an electric potential is applied to the conductive fibers of the brush. This potential creates an electric field between the fibers and the ground plane of the photoreceptor. The toner particles experience a force F equal to the product (q*E), where the term q represents the toner charge and E the electric field. This force, qE, must exceed the adhesion force between the toner particles and the photoreceptor surface in order to detach the particles. The electrical force, when combined with the mechanical (deflection) forces of the fibers, detaches and removes charged toner particles from the photoreceptor surface.

This technique works reasonably well for the toner materials in use today. The main draw back of this technique is the inability of the brush fibers to remove large amounts of toner efficiently. For example, when the copy process is aborted due to a paper jam, the cleaning subsystem must remove large amounts of untransferred toner. This represents a stress case for conventional electrostatic cleaner. The reason for this poor performance is that the charged toner particles collect at the fiber tip and screen the electric field of the fiber and shut off the toner removal process as shown in FIG. 1. FIG. 1 shows a biased conductive fiber of a cleaner brush. The fiber 108 collects a mass of positively charged toner particles 111 about the fiber tip thus, reducing the electric field by shielding the incoming toner from the fiber. Moreover, preclean charging of the toner particles on the photoreceptor results in increased force of adhesion between the photoreceptor and the toner particles. This increase in adhesion force reduces cleaning efficiency.

The AC-ESB (alternating current-electrostatic brush) cleaner of the present invention does not have the disadvantages of the conventional DC-ESB (direct current-electrostatic brush). The DC-ESB relies on charged toner for its operation, while the AC-ESB exploits the dielectric polarization forces (DEP) to attract uncharged toner particles. The toner particles are discharged by appropriate preclean charge treatment. This treatment ensures that the average charge of the toner particles is about 0 $\mu$C/g. An alternating bias (in the frequency range 50–500 Hz) is applied to the brush fibers. The toner particles, polarized by electric field in the vicinity of the fiber tip, are attracted to the fiber tip by the nonuniform electric field as shown in FIG. 2.

Referring to FIG. 2, which shows an uncharged toner particle 112 polarized by an electric field 200 in the vicinity of a biased conductive brush fiber 108. The toner particle 112 is attracted to the fiber tip by the nonuniform electric field 200. This force depends on the gradient of the electric field. Near the fiber tip, the electric field gradient is very large. Since the toner is uncharged, the adhesion force between the toner particles and the PR is greatly reduced. In addition, the electric field of the fiber tip is not screened. This allows each fiber to remove more toner than it would if the toner is charged. The alternating potential of the brush ensures that all toner particles are removed regardless of the polarity of their residual charge.

Figure 3:
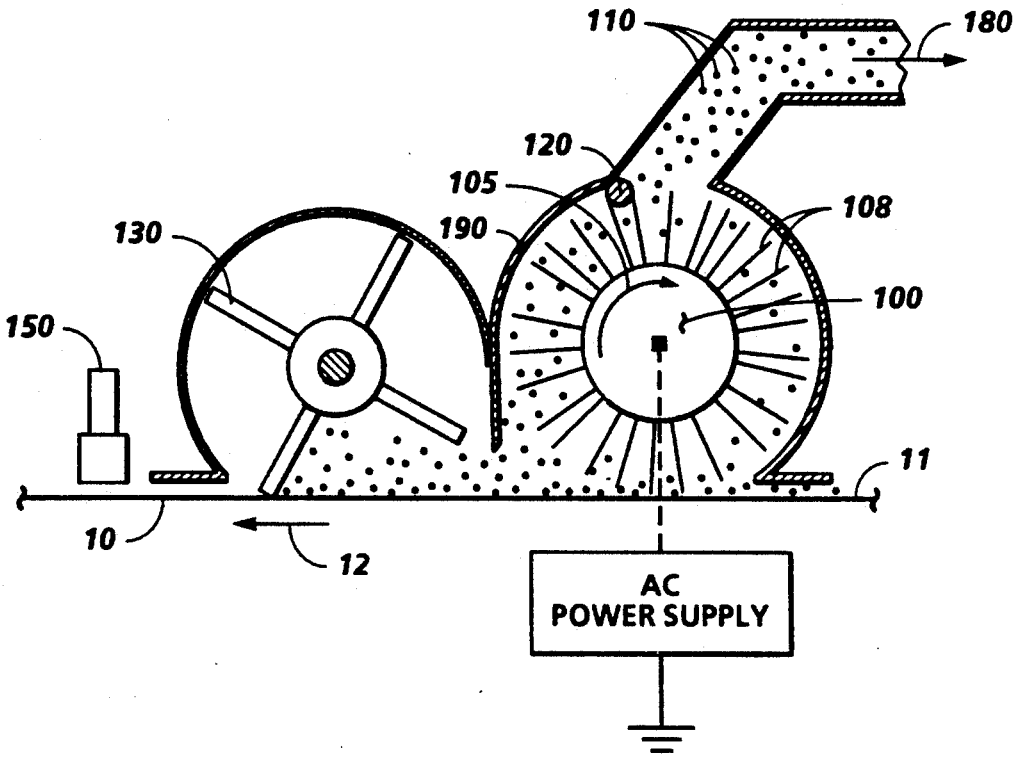
FIG. 3 is a schematic elevational view of an AC biased electrostatic brush with a multi-blade follow-up.

Referring now to FIG. 3 which shows a hybrid cleaning system consisting of an AC-ESB (alternating current-electrostatic brush) and a multi-blade cleaner. The primary cleaner of the system is the electrostatic brush 100 with an AC bias which is designed to pick up the bulk of the toner 110 on the imaging surface 11. The fibers of this brush 100 rotate, in the direction of arrow 105, against the imaging surface 11. A flicker bar 120 (or charging bar) is located above the brush fibers 108. The brush fibers 108 rotatingly contact the flicker bar 120. The vacuum 180 generates an air flow that pulls the toner 110 from the brush fibers 108, out of the housing 190, and deposits this toner and other waste material cleaned from the photoreceptor surface into a waste container (not shown). However, the AC-ESB often redeposits toner on the imaging surface 11 during cleaning. This redeposition of toner occurs when some of the toner 110, removed from the photoreceptor surface 11, by the cleaning brush 100 is not removed from the cleaning brush. As the rotating cleaning brush 100 recontacts the photoreceptor surface 11, some of the toner 110 remaining in the brush 100 is transferred back onto the photoreceptor surface 11 due to the electrostatic forces generated by the AC bias.

With continued reference to FIG. 3, the secondary cleaner for the residual toner (and particles) that is redeposited or not picked up by the primary cleaning method is a multi-blade assembly 130. The multi-blade assembly 130 is located upstream from the AC-ESB 190 in the direction of movement, by the photoreceptor 10, indicated by arrow 12. The brush could be biased to a high level (for example, 500 v peak) to allow for the maximum mass cleaning capability, while not being overly concerned about mild redeposition or air-breakdown failures, since the blade would clean the residual toner (and particles) from the imaging surface 11. (An air-breakdown failure is when too high of a voltage occurs on the brush, a short between the fibers and the photoreceptor occurs, causing the loss of charge on the toner or altering of the toner charge.) The blade would be followed by a sensor 150 to detect cleaning blade failures in the multi-blade assembly 130, thereby, providing information to allow for blade assembly indexing and the use of a new blade edge. The vacuum 180 would be used to remove all toner from the cleaner cavity, as discussed above, including the blade area.

Figure 4:
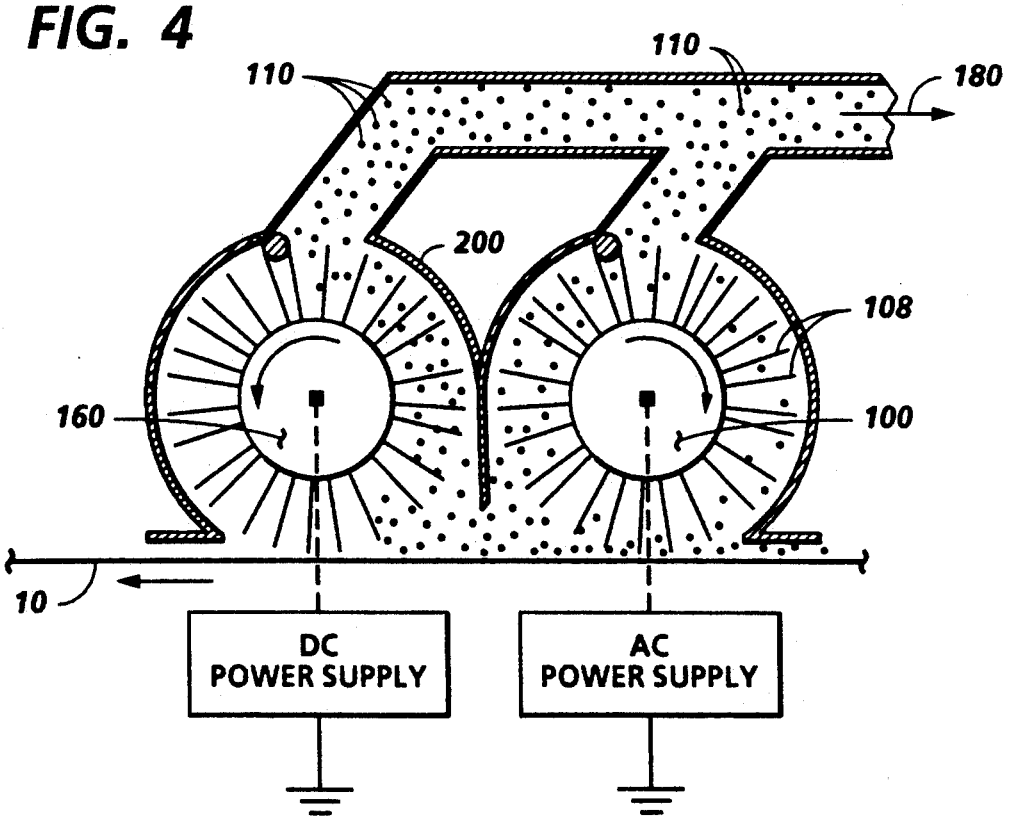
FIG. 4 is a schematic elevational view of an AC biased electrostatic brush with a DC biased follow-up brush.

Referring now to FIG. 4 which shows an alternative cleaning method that encompasses a dual brush cleaning system. The primary cleaner is an electrostatic brush 100 with an AC bias followed by a DC (direct current) biased brush 160 as a secondary cleaner. The first brush 100, of the dual brush configuration, is AC biased and cleans the bulk of the toner 110. The second brush 160 is biased with a DC bias to clean the redeposited toner (and other particles) from the imaging surface. The first brush 100 could be biased to a high level (for example, 500 v peak) to allow for maximum mass cleaning capability, while not being overly concerned about mild redeposition or air-breakdown failures, since the second brush 160 would clean that residual toner. (An air-breakdown failure, as described above, is when too high of a voltage occurs on the brush (or if the the fibers of the AC and/or DC brushes were to come in contact with each other), a short between the brush fibers 108 and the photoreceptor 10 occurs, causing the loss of charge on the toner or altering of the toner charge. Hence, the dual brushes are separated by a housing 200.). The high mass cleaning of the first brush 100 results in a low mass input to the second brush 160, thus, reducing the possibility of toner emissions from that side of the cleaner containing the second brush 160.

Figure 5:
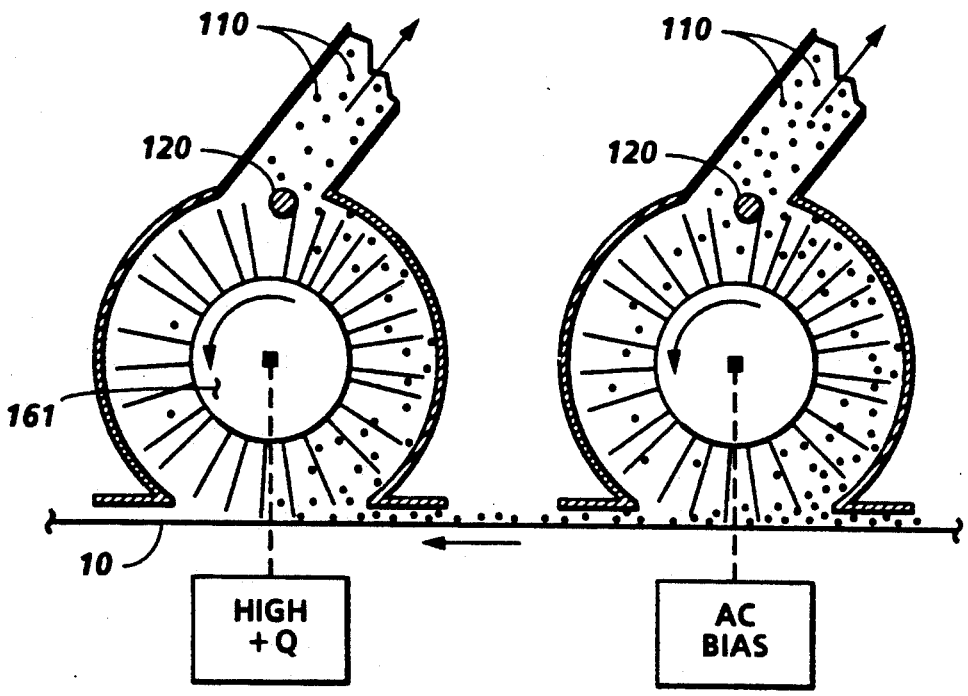
FIG. 5 is a schematic elevational view of an AC biased brush with an insulative follow-up brush.

Referring now to FIG. 5 which shows an alternative dual brush cleaning system. FIG. 5, through similar to FIG. 4, uses an insulative follow-up brush 161 rather than the DC bias follow-up brush shown in FIG. 4.

In recapitulation, the preferred method of cleaning particles from the imaging surface of the photoreceptor is by having an AC electrostatic brush remove the bulk of the residual particles on the imaging surface. The residual particles are discharged to about 0 $\mu C/g$ by a preclean corotron to allow the DEP forces of the AC biased brush to attract a large amount of residual particles from the imaging surface. This AC biased brush cleaning method can redeposit some of the particles back on the imaging surface and/or due to air-breakdown failures leave residual particles on the imaging surface. Hence, a secondary cleaning means is needed. This secondary cleaning means can be a blade cleaner or another brush cleaner. The secondary cleaners for removing residual toner due to redeposition and/or air breakdown failures of the AC biased brush described herein include: a multi-blade assembly, a DC biased brush and an insulative brush. Each of these secondary cleaners can be combined with the AC biased brush for a more effective cleaning apparatus for the imaging surface.

It is, therefore, apparent that there has been provided in accordance with the present invention, an electrostatic brush cleaner with a secondary cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing residual particles from an imaging surface, comprising:

a housing defining an open ended chamber;

means for discharging the particles on the imaging surface;

a first brush, rotatably mounted in the chamber of said housing, for removing the discharged particles from the imaging surface;

said discharging means includes a corona generating device located downstream of said first brush in the direction of movement of the imaging surface;

means for electrically biasing said first brush with an alternating current;

a second brush, located upstream of said first brush;

means for electrically biasing said second brush with a direct current; and means, connected to said housing for generating an air flow that forces the particles away from said first brush and said second brush toward an outlet from said housing.

2. An apparatus as recited in claim 1, wherein said second brush, is rotatably mounted upstream of said first brush, in the direction of movement of the imaging surface.

3. An apparatus as recited in claim 2, wherein said second brush rotates in a direction opposite that of said first brush.

4. An apparatus as recited in claim 2, wherein said second brush is mounted exteriorly of said housing.

5. An apparatus for removing residual particles from an imaging surface, comprising:

a housing defining an open ended chamber;

means for discharging the particles on the imaging surface;

a first brush, rotatably mounted in the chamber of said housing, for removing the discharged particles from the imaging surface;

said discharging means includes a corona generating device located downstream of said first brush from the direction of movement of the imaging surface;

means for electrically biasing said first brush with an alternating current;

a second brush being insulative, is located upstream of said first brush; and means, connected to said housing, for generating an air flow that forces the particles away from said first brush and said second brush toward an outlet from said housing.

* * * * *